US008499816B2

(12) United States Patent
Taddei

(10) Patent No.: US 8,499,816 B2
(45) Date of Patent: Aug. 6, 2013

(54) SECTIONAL DOOR PARTICULARLY FOR GARAGE

(75) Inventor: Silvio Taddei, Lazise (IT)

(73) Assignee: SILVENTA S.r.l., Castelnuovo (TN) (IT)

( * ) Notice: Subject to any disclaimer, the term of this patent is extended or adjusted under 35 U.S.C. 154(b) by 46 days.

(21) Appl. No.: 13/355,785

(22) Filed: Jan. 23, 2012

(65) Prior Publication Data

US 2012/0222825 A1 Sep. 6, 2012

(30) Foreign Application Priority Data

Mar. 1, 2011 (IT) ..... VR2011A0040

(51) Int. Cl.
*E05F 11/00* (2006.01)

(52) U.S. Cl.
USPC ..... 160/190; 160/202; 160/211

(58) Field of Classification Search
USPC ..... 160/201, 202, 203, 205, 206, 207, 160/211, 213, 214, 220, 223, 189, 190
See application file for complete search history.

(56) References Cited

U.S. PATENT DOCUMENTS

| | | | | | |
|---|---|---|---|---|---|
| 734,155 | A | * | 7/1903 | Barnes et al. | 160/211 |
| 1,163,065 | A | * | 12/1915 | Bryan | 160/202 |
| 1,191,929 | A | * | 7/1916 | Prescott | 160/189 |
| 1,248,755 | A | * | 12/1917 | Tomkinson | 160/190 |
| 1,248,756 | A | * | 12/1917 | Tomkinson | 160/190 |
| 1,253,302 | A | * | 1/1918 | Tomkinson | 160/190 |
| 1,273,923 | A | * | 7/1918 | Prescott | 160/193 |
| 1,274,443 | A | * | 8/1918 | Prescott | 160/188 |
| 1,275,591 | A | * | 8/1918 | Ogden et al. | 160/189 |
| 1,282,113 | A | * | 10/1918 | Ogden et al. | 160/189 |
| 1,282,146 | A | * | 10/1918 | Tomkinson | 160/207 |
| 1,285,284 | A | * | 11/1918 | McCloud | 160/202 |
| 1,358,356 | A | * | 11/1920 | Boughton | 160/189 |
| 1,386,192 | A | * | 8/1921 | McCloud | 160/189 |
| 1,532,560 | A | * | 4/1925 | Tomkinson | 160/190 |
| 1,537,300 | A | * | 5/1925 | Haines | 160/185 |
| 1,579,677 | A | * | 4/1926 | Tomkinson | 160/189 |
| 1,606,976 | A | * | 11/1926 | Tomkinson | 160/202 |
| 1,646,432 | A | * | 10/1927 | Tomkinson | 160/190 |
| 2012/0222825 | A1 | * | 9/2012 | Taddei | 160/223 |

FOREIGN PATENT DOCUMENTS

| | | |
|---|---|---|
| EP | 0606956 | 7/1994 |
| FR | 2501772 | 9/1982 |
| GB | 29960 | 0/1913 |

OTHER PUBLICATIONS

Italian Search Report dated Nov. 25, 2011, corresponding to Foreign Priority Application No. IT VR201100040.

* cited by examiner

*Primary Examiner* — Blair M. Johnson
(74) *Attorney, Agent, or Firm* — Young & Thompson

(57) ABSTRACT

A sectional door for controlling the access opening to a compartment, includes a fixed portion including two pairs of vertical guides extending in a direction substantially parallel to a respective shoulder of the opening; and a movable portion including a leaf having a lower panel and an upper surrounding panel, extending over the entire width of the leaf and having its lateral sides in sliding engagement along a respective side guide, a pair of side support arms each having one end thereof articulated in correspondence to the top of a respective pair of vertical guides and the other end thereof pivoted in correspondence to an intermediate zone of a respective lateral side of the upper panel, and articulated and slidable connection elements between the lower panel and the upper panel, whereby the lower and upper panels are movable between a closed, and an open position.

32 Claims, 14 Drawing Sheets

SECTIONAL DOOR PARTICULARLY FOR GARAGE

TECHNICAL FIELD

The present invention relates to a sectional door, particularly suitable for a garage.

BACKGROUND ART

Sectional doors, as is known, have a single leaf, mounted sliding inside a pair of identical sliding guides, which at the side restrict the access opening to one compartment intended to be closed by the door (garage). The sliding guides have a substantially overturned L-shaped configuration and each has a substantially vertical lower section, secured behind the access opening, an upper section substantially horizontal or sloped with respect to a horizontal plane, normally fastened to the ceiling or along the side walls of such compartment, and a curved connecting section between the lower section and the upper section. The upper section of each guide extends towards the inside of the compartment by a section having a length substantially the same as the height of the door.

The leaf of a sectional door is usually made up of a plurality of substantially rectangular panels, each with a width equal to the width of the access opening to the compartment, articulated the one to the other, preferably hinged, along the respective ends or transversal edges. Such panels also have, in correspondence to the respective ends or transversal edges of the sliding means, e.g., of idle rollers, so as to slide in the above side sliding guides.

The sliding of the leaf within the side guides of the door is done by operating means of any suitable type, whether manual or automatic, which allow obtaining the sliding of the above panels within the sliding guides partially vertical, curved and horizontal or almost, so as to free or obstruct access to the above compartment. A sectional door, in fact, can be moved from a completely closed position wherein the panels making up the leaf are all arranged along a substantially vertical plane in correspondence to the opening of the compartment, to a completely open position, wherein the panels are supported by the upper section of the sliding guides fastened in correspondence to the ceiling.

A sectional door, unlike the known swinging doors, during the movement between a closed position and an open position or vice versa, does not protrude outside the access opening. Such prerogative of sectional doors is however accompanied by a number of drawbacks. Among these, the fact that each upper section of the sliding guides of the sectional doors must be fastened to the ceiling or laterally to the walls of the compartment by means of cumbersome and ugly supporting structures which also require, among other things, fairly long installation and fitting times. Again, the sectional doors, once opened, have their leaf arranged along a relatively large portion of the ceiling of the compartment, usually a garage or warehouse, which reduces the room available in such compartment.

It appears evident therefore that it would be a good thing to reduce the overall dimensions of the sectional doors when these are in open position.

The patent document GB 29,960 shows a different type of door, the leaf of which is split into a plurality of panels which can slide vertically along a series of vertical guides.

Once raised, the panels are positioned one by the side of the other inside a boxed member rotatable between a vertical configuration and a horizontal configuration, in which it protrudes towards the inside of the compartment so as to reduce the vertical overall dimensions of the door.

Also this type of door, however, can be upgraded in order to obtain a simpler, more rational, efficient and cheapest solution.

DESCRIPTION OF THE INVENTION

The main object of the present invention therefore is to provide a sectional door structure which, unlike the doors presented thus far by the state of the art, does not require the fastening of the upper sections of the sliding guides to the walls or to the ceiling of the respective compartment and which is easy to install in less time compared to that required by traditional sectional doors.

Another object of the present invention is to provide a sectional door which, in open position, has reduced overall dimensions on the ceiling compared to the sectional doors presented thus far by the state of the art.

A further object of the present invention is to provide a sectional door which is safe to handle and resistant to break-in attempts.

Yet another object of the present invention is to provide a sectional door that is easy to make and install and is obtainable at competitive production costs.

The above mentioned objects, which will be better disclosed further on, are achieved by a sectional door for the control of the access opening to a compartment, particularly to a garage compartment, comprising:

- a fixed portion including two pairs of vertical guides suitable for extending in a direction substantially parallel to a respective shoulder of the access opening to a compartment; and
- a movable portion including:
  - a leaf comprising a lower panel and an upper surrounding panel, substantially rectangular in shape extending over the entire width of the leaf and having the lateral sides thereof in sliding engagement along a respective side guide;
  - a pair of side support arms each having one end thereof articulated in correspondence to the top of a respective pair of vertical guides and the other end thereof pivoted in correspondence to an intermediate zone of a respective lateral side of said upper panel; and
  - articulated and slidable connection means between said lower panel and said upper panel, including a pair of lateral sliding guides provided in correspondence to the lateral sides of said upper panel, and a pair of connection levers, each having one end thereof in sliding engagement with a respective lateral sliding guide of said upper panel and a second end thereof articulated at the top to said lower panel, whereby said lower and upper panels are movable between a completely closed position of said access opening, in which they are arranged in a substantially aligned sequence, one on top of the other, along said pairs of vertical guides, and a completely open position, in which said upper panel is overhangingly moved to project in said compartment starting from a zone in correspondence to the top of said pairs of vertical guides, supported by said pair of side support arms, and said lower panel is moved together with, and against said upper panel.

BRIEF DESCRIPTION OF THE DRAWINGS

Other characteristics and advantages of the present invention will become more evident from the description of some preferred, but not sole, embodiments, illustrated purely as an example but not limited to the annexed drawings in which.

EMBODIMENTS OF THE INVENTION

Figure 1:
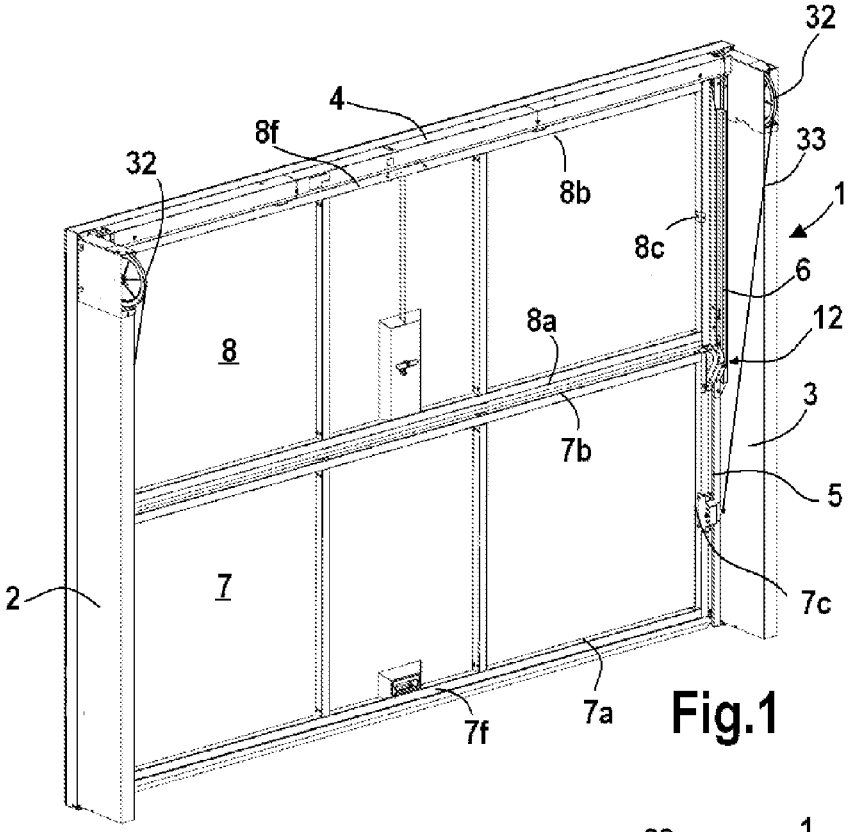
FIG. 1 is a perspective view, slightly from above, of a sectional door according to the present invention seen from the rear, i.e. from the part of the compartment which the door is intended to close.
Figure 2:
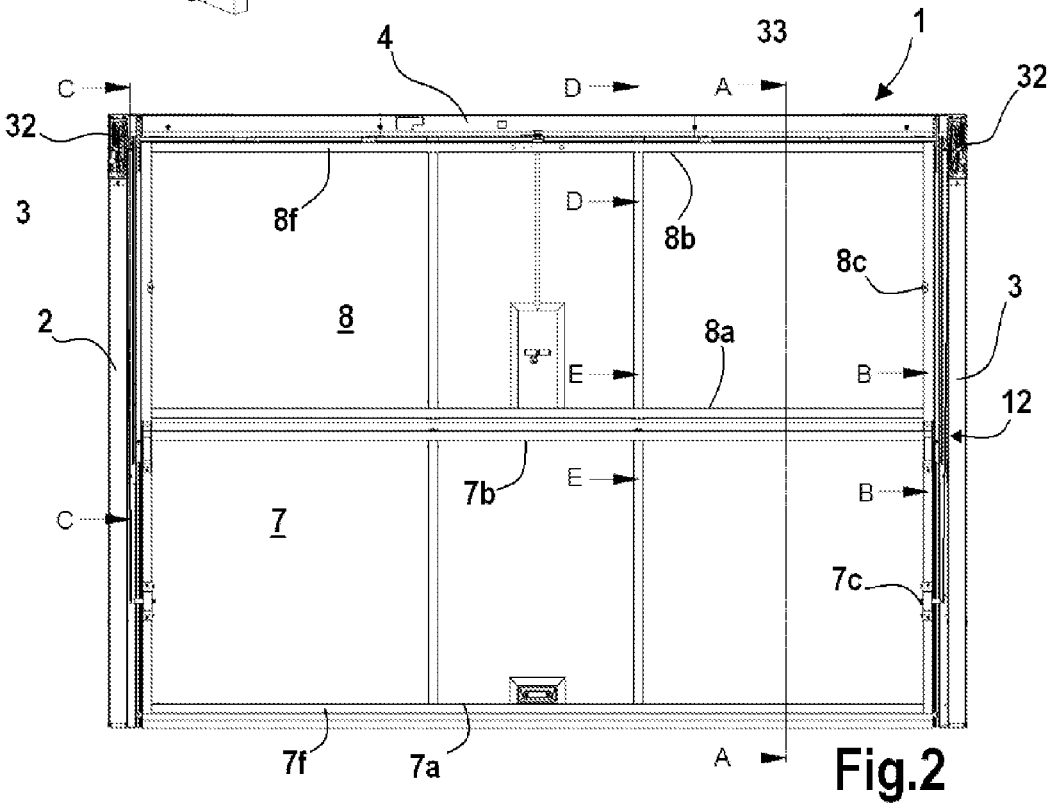
FIG. 2 illustrates a front view of the same face of the sectional door shown in FIG. 1.

On the attached drawings, identical or similar parts or components have been marked by the same reference numbers.

With reference first of all to the FIGS. 1 to 6, it will be seen how a sectional door for the control of the access opening to a compartment, in particular to a garage or warehouse compartment, according to the present invention is marked by the reference number 1 and is made up of a frame or fixed portion, which includes a pair of lateral support uprights 2, 3, connected together at the top by an upper crossbar 4 and suitable for being fastened behind and to the main beam of the access opening to the compartment, respectively.

To each lateral support upright 2, 3 is fastened, in any suitable way, a respective pair of side guides or vertical guides 5, 6. Each vertical guide 5 (see in particular FIG. 6) has a length roughly identical to that of the respective lateral support upright 2 or 3, while each vertical guide 6 has a length roughly identical to half that of the respective vertical guide 5 and is secured to the respective lateral support upright 2, 3 in a position adjacent to the vertical guide 5 and extends parallel to this from the internal part of the compartment roughly in correspondence to the upper half of the adjacent guide 5.

The sectional door according to the present invention also comprises a movable portion including a leaf made up of a panel 7, arranged in use in the lower part of the leaf, and a panel 8, upper in use, which both have a substantially rectangular outline and extend along the entire width of the leaf. In correspondence to their sides, the panels 7 and 8 are meant to engage sliding along a respective vertical guide 5, 6.

Typically, each vertical guide 5, 6 has a substantially C-shaped profile in cross section. The concavity of a pair of vertical guides 5, 6 is turned towards the other pair. The vertical guides 5 are meant to engage sliding, in use, with a respective sliding block or idle roller 9 conveyed by a respective pin protruding laterally in an overhanging way in correspondence to a lower section 7*a* of the lower panel 7, while each vertical guide 6 acts as a sliding engagement seat for a respective sliding block or idle roller 9*a* (visible in the FIGS. 11 and 12) conveyed by a respective pin protruding in an overhanging way in correspondence to a lower section 8*a*, in closed position, of the upper panel 8. Preferably, the panels 7 and 8 have an inner frame, marked 7*f* and 8*f* respectively, and the frame of the upper panel 8 supports a pair of side sliding guides 10 having a length substantially equal to or slightly greater than the height of the panel 7.

Figure 4:
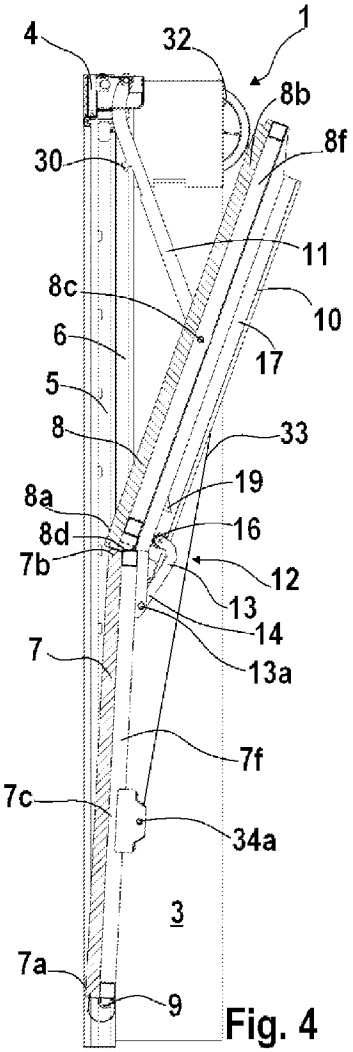
Figure 3:
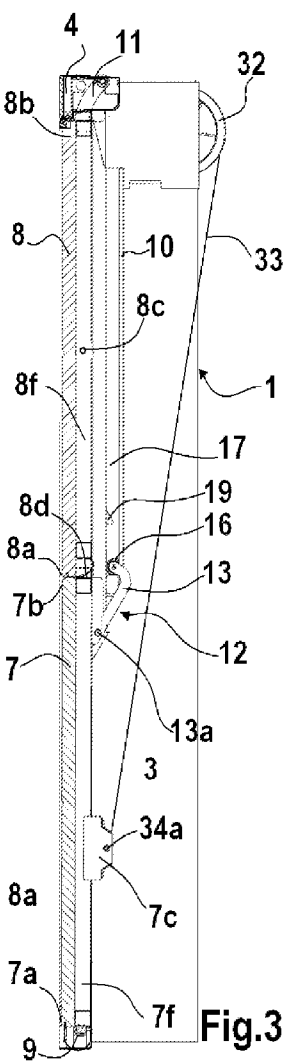

The upper panel 8 is laterally articulated to a hinging axis 8*c* in correspondence to one of its intermediate areas and to an end of a pair of side support arms 11 having their other articulated end in correspondence to the top of a respective pair of vertical guides 5, 6 or of the lateral support uprights 2, 3 (FIG. 4).

Figure 9:
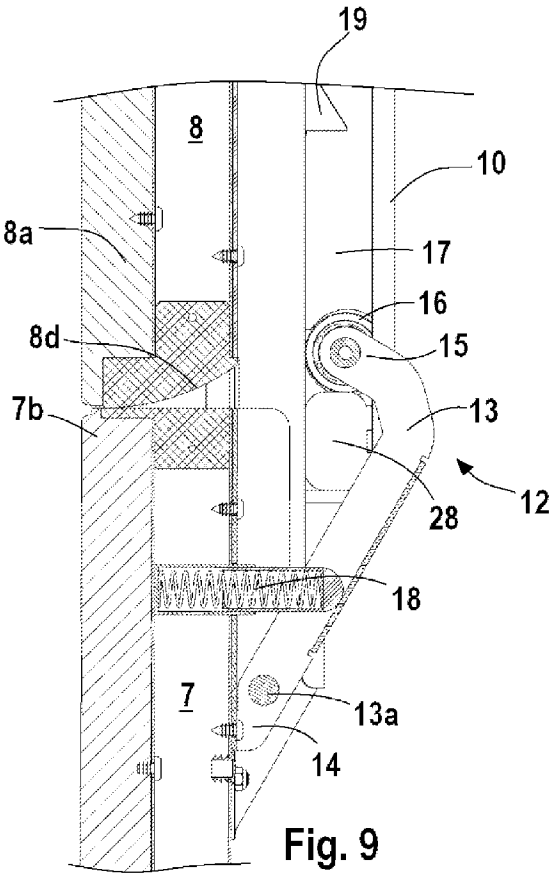

The lower panel 7 and upper panel 8 are linked together, in correspondence to their ends or side edges, by means of two articulated and slidable connection means or groups 12, one on either side, so as to form a single leaf for the sectional door. More in particular, each articulated and slidable connection group 12 (FIGS. 6, 9 and 14) laterally connects the upper section 7*b* of the lower panel 7 to the lower section 8*a* of the upper panel 8 and is made up of a connection lever or arm 13 with elbow configuration.

Each connection lever 13 has a first end 15 having a sliding block or idle roller 16, designed, in use, to run along a respective sliding seat 17 delimited within the respective side sliding guide 10 of the upper panel 8.

Each connection lever 13, furthermore, has a second end 14 pivoted on a pin 13*a* in correspondence to the upper section 7*b* of the lower panel 7.

Preferably, for each articulated and slidable connection group 12 a resilient loading means 18 is provided, e.g., a suitable compression spring between the upper section 7*b* of the lower panel 7 and the connection lever 13, which, therefore, due to the action exercised by the spring 18 always remains pushed towards the inside of the compartment, i.e., in the direction of moving away from the panel 7.

With such a configuration, the lower panel 7 and upper panel 8 are moveable between a position of complete closing of the access opening, in which they are arranged in sequence substantially aligned one above the other along the pairs of vertical guides 5, 6, and a position of complete opening, in which the upper panel 8 finds itself moved to protrude overhanging in the garage compartment starting from an area in correspondence to the top of the pairs of vertical guides 5, 6 sustained by the pair of side support arms 11 and the lower panel 7 is moved together with, and against the upper panel 8.

Figure 5:
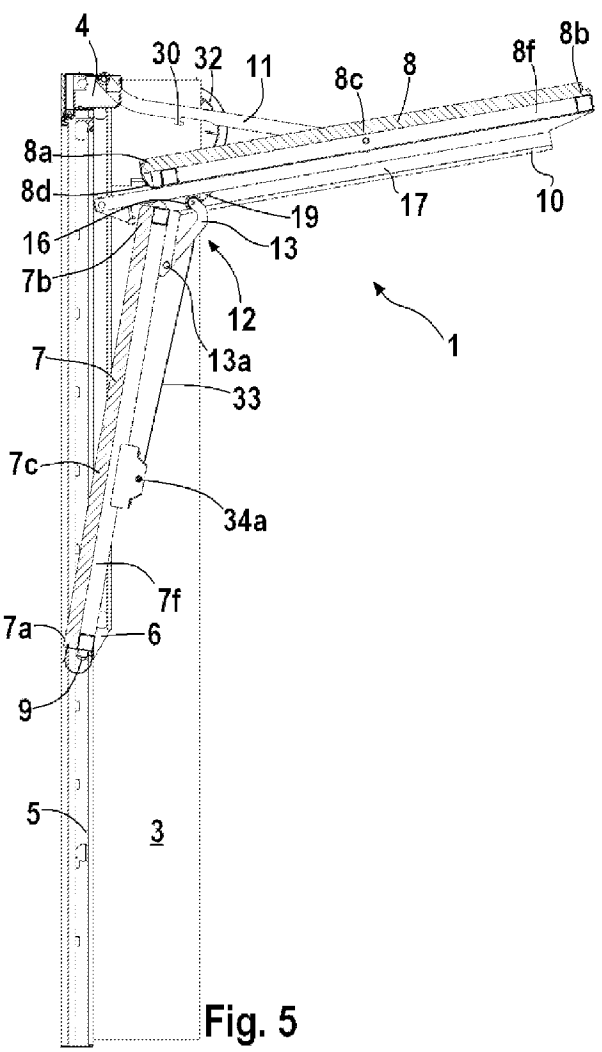
FIGS. 3 to 5 show section views, on enlarged scale, taken along the track plane A-A of FIG. 2, illustrating the first three sequential phases of door opening according to the present invention.
Figures 6, 7, 8:
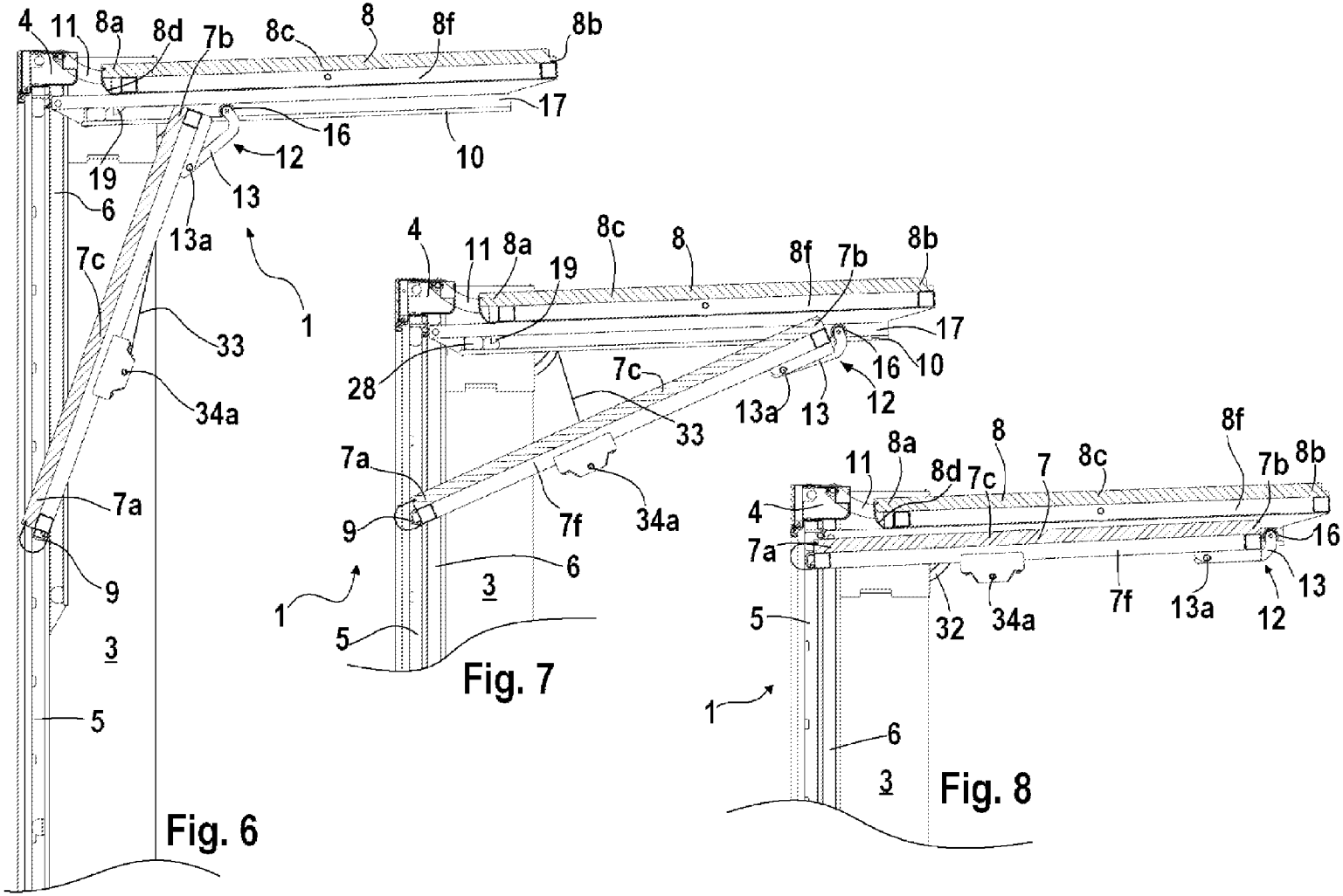
FIGS. 6 to 8 are section views, on enlarged scale, taken along the track plane A-A of FIG. 2, illustrating other three sequential phases of door opening according to the present invention, subsequent to those of FIGS. 3 to 5.

By observing in particular the FIGS. 3 to 8, it will be seen how the rollers 9 of the lower section 7*a* of the panel 7, starting from a layout of complete closing (FIG. 3), upon the manual lifting action of the user exercised on the lower panel 7, are pushed to slide upwards along the respective vertical guides 5. This also translates into the lifting of the upper panel 8, which, being initially sustained in equilibrium of alignment with the panel 7 and up fast at the top against a stop, typically the crossbar 4, is unbalanced and made to "fall" in a controlled way towards the inside of the compartment in rolling support (in correspondence to its preferably rounded lower edge 8*d*) on the upper section 7*b* of the panel 7 and oscillating around the articulation axis 8*c* of the side support arms 11. The rollers 9*a* of the upper panel 8 start to slide along the vertical guides 6, and so the lower section 8*a* of the panel 8 is guided to move upwards again, until it takes on an almost horizontal layout (FIG. 5). Continuing the lifting, the upper section 7*b* of the lower panel 7, which is secured to the side sliding guides 10 of the upper panel 8 by means of the connection levers 13 and the rollers 16, is pushed to move along and parallel to the upper panel 8 until it is packed up against and below this (FIGS. 6 to 8).

Until the substantially horizontal layout of the upper panel 8 is reached, the rollers 16 of the articulated and slidable connection groups 12 remain abutted against respective removable grip pawls 19 protruding in the sliding seat 17 of each side sliding guide 10. More in particular, each grip pawl 19 is part of a respective safety group 20 having several functions.

In particular the safety group 20 is suitable for:

- temporarily blocking the first end 15 of the connection levers 13 in the proximity of the lower section 8*a* of the upper panel 8 until the upper panel 8 reaches a substantially horizontal configuration, and for
- releasing the first end 15 of the connection levers 13, leaving this free to slide along the respective side sliding guide 10, when the upper panel 8 is in a substantially horizontal configuration.

In point of fact, during the opening of the door 1 starting from the position of complete closing, the panels 7, 8 remain initially articulated the one with the other thanks to the connection levers 13, which have the first end 15 hinged in correspondence to the lower section 8*a* of the upper panel 8 and the second end 14 hinged to the upper section 7*b* of the lower panel 7, until the door 1 reaches an intermediate position wherein the upper panel 8 is substantially horizontal.

From now on the upper panel 8 remains stopped in horizontal position and the first ends 15 of the connection levers 13 begin to slide along the side sliding guides 10, until they reach the position of complete opening.

Two safety groups 20 are present, one for each side of the door 1.

Figure 10:
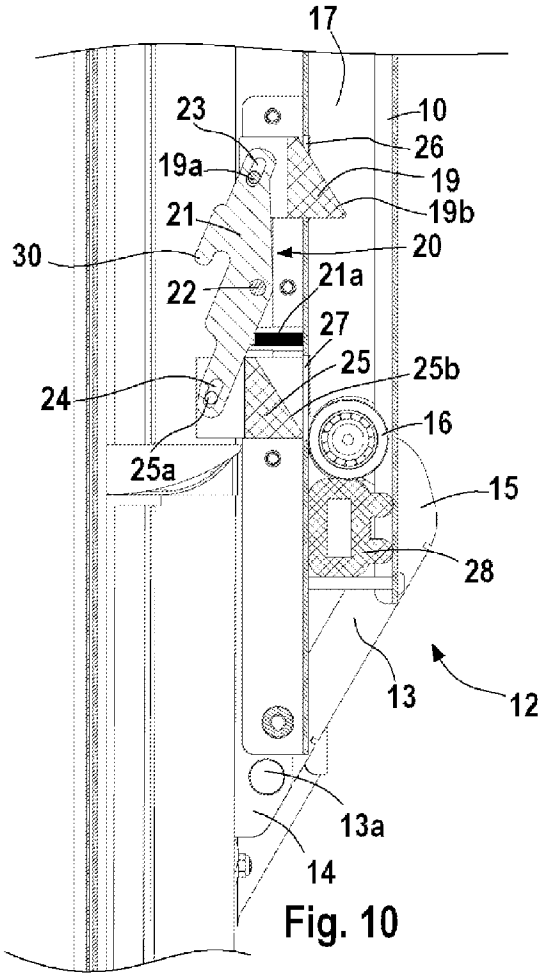
FIGS. 9 and 10 are section views, on enlarged scale, of some construction details of the sectional door according to the present invention, taken along the track planes B-B and C-C of FIG. 2, respectively.
Figure 11:
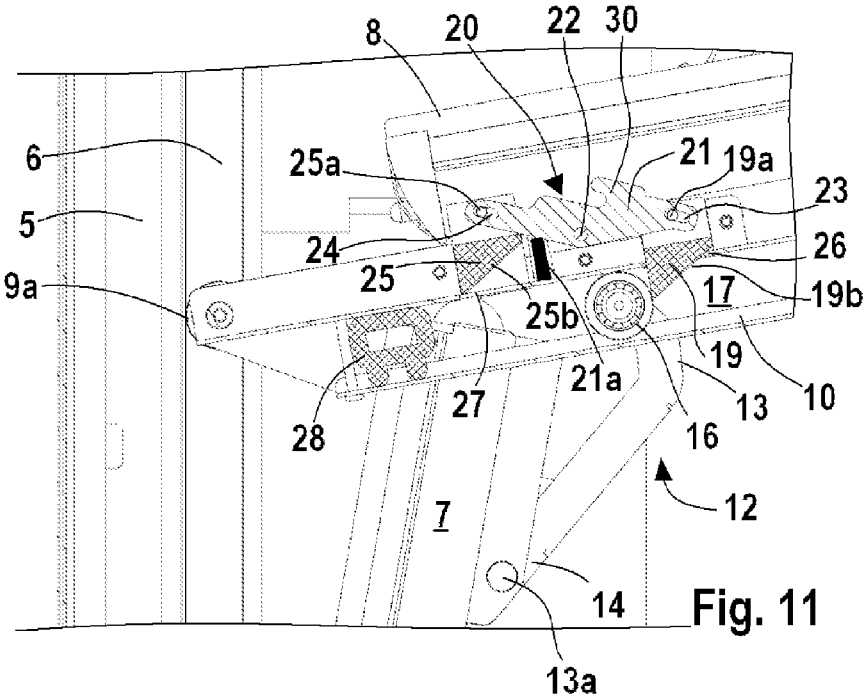
FIG. 11 illustrates a section view, on enlarged scale, taken along the track plane C-C of a construction detail of the door in the opening phase.
Figure 12:
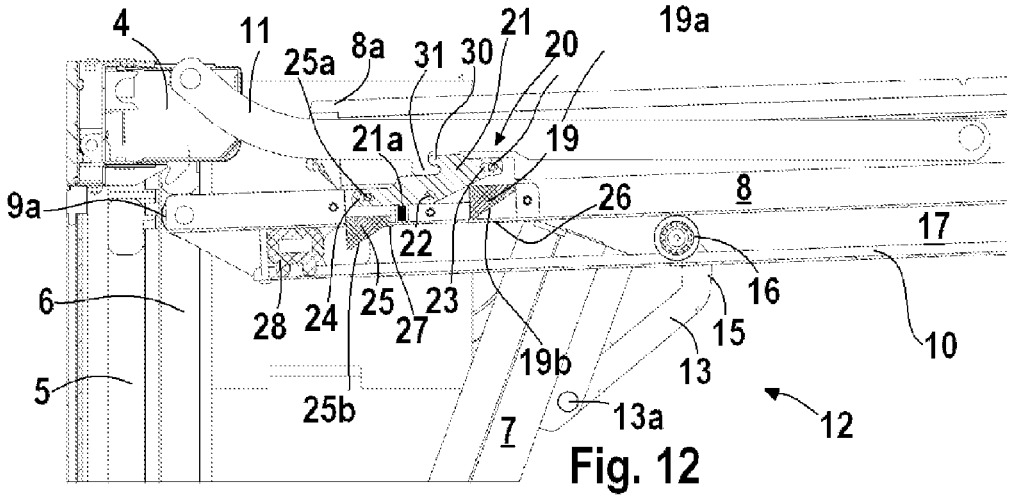
FIG. 12 shows a further section view, on enlarged scale, taken along the track plane C-C of the same construction detail of FIG. 11 in a phase subsequent to door opening.

In the embodiment shown in the FIGS. 10 to 12, each of the two safety groups 20 comprises an equalizing member 21 pivoted on an intermediate pin 22 borne by the frame 8*f* in correspondence to a respective side edge of the lower section 8*a* of the upper panel 8. At the two ends thereof, the equalizing member 21 has two slots 23, 24 designed to receive, sliding, a respective pin 19*a*, 25*a*, the pin 19*a* being fastened to the grip pawl 19, while the pin 25*a* is fastened to a wedge 25. Preferably, both the grip pawl 19 and the wedge 25 have the same configuration with inclined plane back, 19*b* and 25*b* respectively, orientated by a same direction with respect to the respective sliding seat 17. The grip pawl 19 and the wedge 25 are fitted sliding within a respective through housing opening 26, 27, obtained in the frame 8*f* and leading into the respective sliding seat 17, so that, depending on the angular position of the equalizing member 21 in the sliding seat 17 involved, either the grip pawl 19 or the wedge 25 protrudes. Each safety group 20 optionally has a resilient loading means, e.g., a spring 21*a*, which keeps the equalizing member 21 orientated in such a way that the grip pawl 19 is normally inserted in the sliding seat 17. The equalizing member 21 of each safety group 20 also has a hook intermediate portion 30 designed to engage with a respective tang 31 provided on the side support arm 11 adjacent to it.

During the opening of the door 1, each grip pawl 19, fitted in the respective sliding seat 17, prevents the sliding of a roller 16 of the respective articulated and slidable connection group 12 towards the upper section 8*b* of the upper panel 8 (FIGS. 5 and 11), until the tangs 31 of the side support arms 11 engage with the hook portions 30 of the respective equalizing members 21 and cause the grip pawl 19 to back up or disappear and the contemporaneous exit of the wedges 25 in the sliding seats 17 (FIG. 12). During the closing movement, the rollers 16 in their backward movement along the sliding seats 17 engage sliding with the inclined plane back 25*a* of the wedge 25, which is thus pushed to back up with the contemporaneous exit of the grip pawls 19, after which, the rollers 16 abut against a stop 28, preferably elastic (FIG. 10).

A sectional door according to the present invention preferably comprises counterweight means 35, 37 which control the reciprocal movement of the lower panel 7 and upper panel 8 and are suitable for making the movement of the door 1 easy and balanced during opening-closing operations. Such counterweight means 35, 37 comprise (see in particular the FIGS. 15 to 17) a pair of first pulleys 32, each housed at the top and on the inside of the lateral support uprights 2, 3. The first pulleys 32 have their rotation axes more or less horizontal and are suitable for supporting a respective first cable 33 fixed, in correspondence to one of its ends, to the lower panel 7, e.g., in correspondence to a respective grip ear, e.g., a pin 34*a*, preferably multiple-position (FIGS. 15-17), being in an intermediate portion of the panel 7 and of its frame 7*f*. The other end of the first cable 33 is connected to a first counterweight 35. The latter is in turn connected by means of a second cable or cables 36 to a second counterweight 37. Both counterweights 35, 37, if so required, are housed within a respective lateral support upright 2 or 3 which, in this case, is contemplated boxed.

Figures 15, 16, 17:
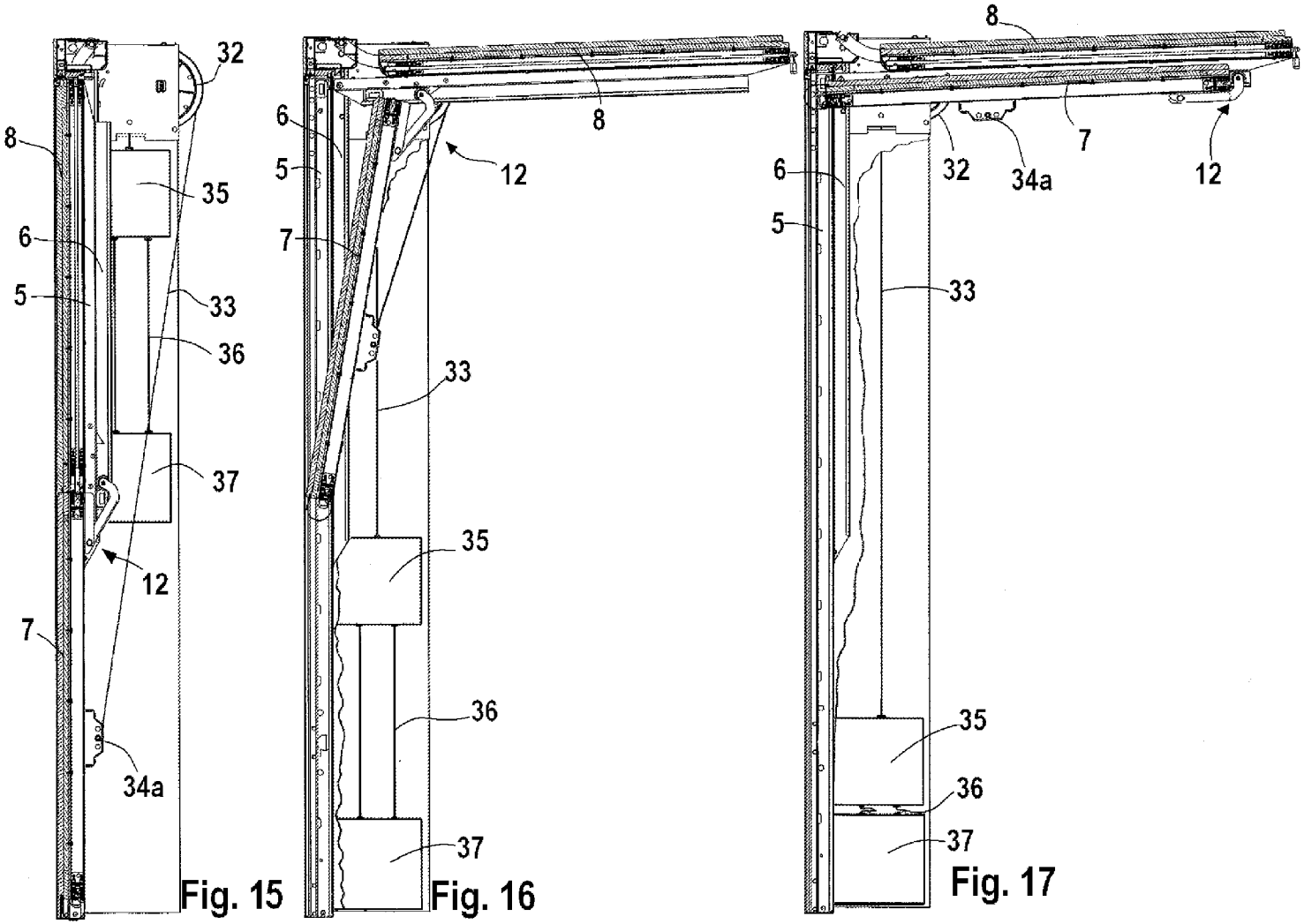
FIGS. 15 to 17, illustrate section views with removed parts of the door represented in FIGS. 3, 6 and 8, respectively, taken along the track plane A-A of FIG. 2.
Figure 20:
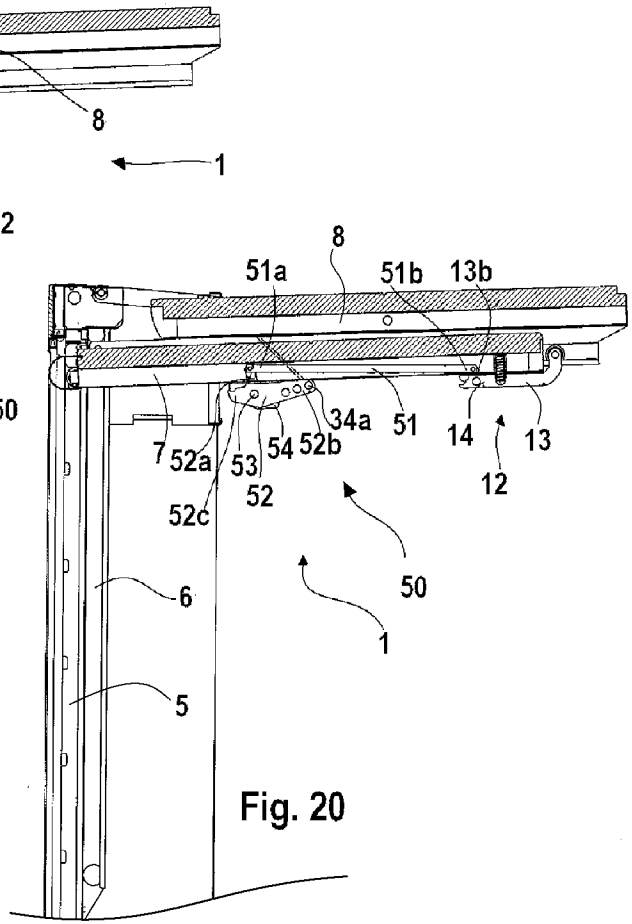
FIGS. 18 to 20 show section views, on enlarged scale, taken along the track plane A-A of FIG. 2 of a variation of the door according to the present invention.

The length of the first cable 33 is roughly equal to the height of both panels (lower 7 and upper 8). When the door 1 is in closed position, the first cable 33 keeps both counterweights 35, 37 suspended (FIG. 15). The weight force due to both counterweights 35, 37 favours the controlled lifting of both the lower panel 7 and the upper panel 8. Once the upper panel 8 is brought to a substantially horizontal position and the roller 16 has abutted against the grip pawl 19 (FIG. 16), the second counterweight 37 has by then reached the ground and the first counterweight 35 is still suspended on the first cable 33. The first cable 33, therefore, discharges the weight force due only to the first counterweight 35 onto the lower panel 7 which, as soon as the hook portions 30 and the coupling tangs 31 of the safety groups 20 and of the side support arms 11 have reciprocally engaged, is free to slide along the sliding seats 17 of the upper panel 8 (because the grip pawls 19 have meanwhile moved away leaving the respective sliding seat 17 free) and thus moves to end of stroke, i.e., until it moves the upper section 7*b* of the lower panel in correspondence to the upper section 8*b* of the upper panel 8, also pushed by the weight force of the first counterweight 35 fitted to it through the first cable 33. In this end-of-stroke position, the panel 7 finds itself in a position parallel to the ground packed below the upper panel 8 and remains there supported by the articulated and slidable connection groups 12 and by the first cable 33, while the first counterweight 35 has also completely dropped (FIG. 17). Preferably, the second connection cable 36 between the two counterweights 35, 37 comprises a pair of cables made of nylon or other similar material, which allows such cables to conveniently slacken between the two counterweights 35, 37 when the door 1 is in fully open position and without creating obstacles or impeding the vertical translational movement of the counterweight weights themselves.

In the closing phase of door 1 starting from its fully open position, an initial backward sliding and controlled fall of the lower panel 7 is produced, this panel being slowed down by the force applied by the first counterweight 35, which will therefore lift up. It will therefore gradually move to a roughly vertical position until the rollers 16 encounter the inclined plane back of the wedges 25, which will be made to back up from the sliding seats 17 with contemporaneous return to work position of the grip pawls 19, and will not abut against the stop 28 with consequent substantially vertical layout of the panel 7. The lifting of the wedges 25 by the rollers 16 causes the disengagement of the hook portions 30 of the safety groups 20 with the respective tangs 31 of the side support arms 11, so that the panel 8 can also take up a substantially vertical position above the lower panel 7 (FIG. 15).

Figure 13:
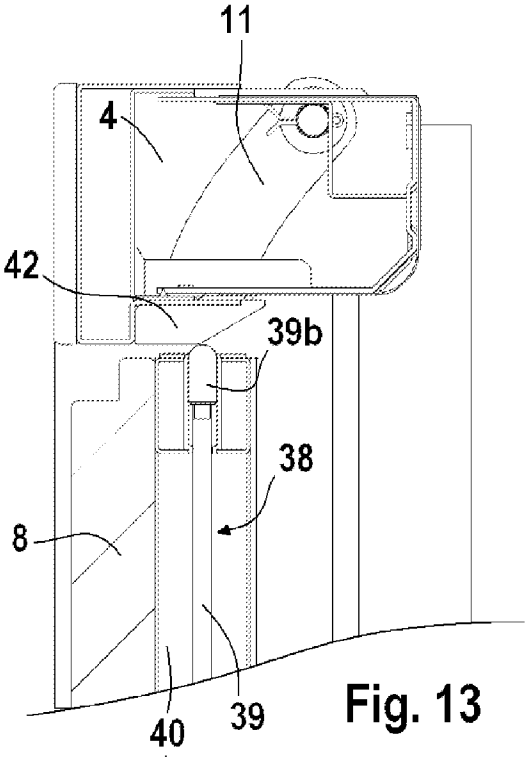

The door 1 according to the present invention preferably comprises anti-tampering means 38 (FIGS. 13 and 14) meant to be started between upper panel 8 and lower panel 7 when the door 1 is in completely closed position. Such anti-tampering means comprise one or more substantially rigid rods 39, e.g., in steel, with a length slightly greater than the height of the upper panel 8, which are fitted vertically translatable in or on the upper panel 8, e.g., within a respective inner through housing seat 40. In correspondence to such inner through seats 40 a respective blind seat 41 is provided in the upper section 7*b* of the lower panel 7, which is meant to receive the lower end of a respective rigid rod 39, when the door 1 is in closed position. For this purpose, the upper crossbar 4 supports a fixed locator with inclined plane 42 designed to engage sliding the head of the respective rigid rods or one rigid rod 39 when placing the upper panel 8 in vertical layout during the closing phase of the door 1.

Figure 14:
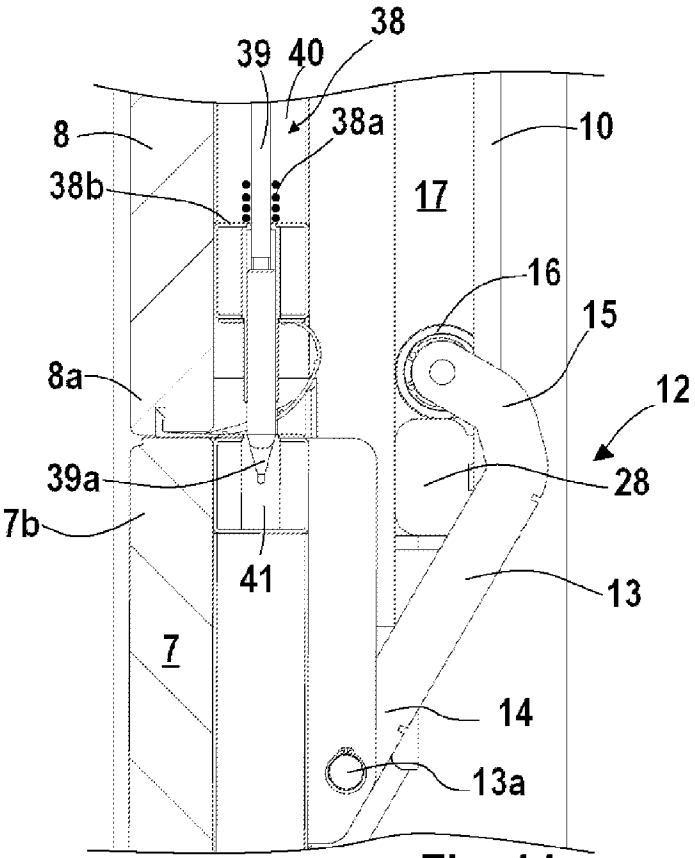
FIGS. 13 and 14, are two section views, taken along the track planes D-D and E-E, respectively, of FIG. 2 of anti-tampering means of the door according to the invention.

The rigid rods 39, in fact, each have their lower end 39*a* normally retracted within the overall dimensions of the upper panel 8 and their upper end 39*b* protruding from the panel 8 during all the intermediate opening and closing phases of the door 1 thanks to the presence of a resilient recalling means, such as, e.g., a helical spring 38*a* having an end abutting against a rod overhang and its other end against a fixed part, such as a guide bush 38*b* for the rod itself (FIG. 14).

In the phase of termination of the complete closing of the door 1, the rigid rod or rigid rods 39 housed in the lower panel 7 find themselves with their upper ends 39*b* in contact with the fixed locator with inclined plane 42 and forced to overcome the resistance of the respective spring 38*a* translating within the upper panel 8 until their lower end 39*a* is fitted removably in the respective seat 41 in the lower panel 7.

The anti-tampering means 38 also perform a further function of helping to keep aligned with one another the lower panel 7 and the upper panel 8 of the door 1 according to the present invention, e.g., when one of the two panels is produced slightly curved, or curves with the passing of time.

The sectional door described above is susceptible to numerous changes and variations within the scope of protection defined by the claims.

Consequently, for example, the movement of the connection lever 13 of each articulated and slidable connection means 12, during the intermediate phases between the fully open position and the completely closed position of the door 1 according to the present invention, can be controlled alternately or jointly with the resilient loading means 18 by means of an articulation group 50 associated with the articulated and slidable connection means 12.

There are two articulation groups 50, one for each side of the door 1, and they are suitable for guiding the movement of the connection levers 13 and of the panels 7, 8 during the movement of the panels 7, 8 between the completely closed position and the completely open position, and vice versa.

Each articulation group 50 is positioned between a respective articulated and slidable connection means 12 and a respective first cable 33.

More in particular, each articulation group 50 is made up of a rod 51 having one of its ends 51*b* pivoted to the connection lever 13 in correspondence to one of its tang portions 13*b* for the purpose provided in correspondence to the second end 14 of the lever itself.

Figure 19:
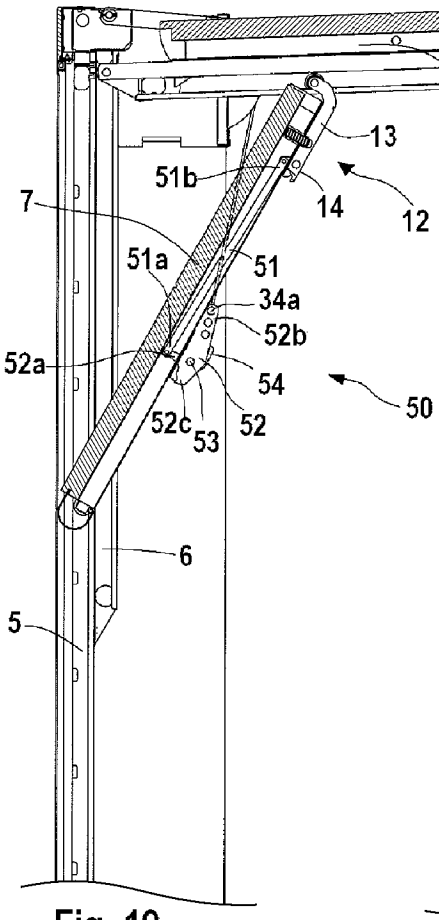
Figure 18:
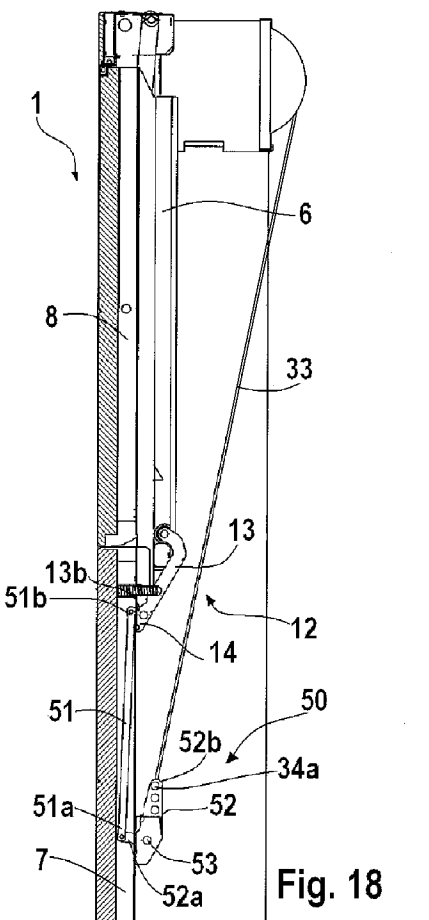

The rod 51 in correspondence to its other end 51*a* is pivoted on a connection member 52, preferably having a substantially L-configuration and in turn pivoted, in correspondence to its elbow portion, to a pin 53 substantially horizontal and parallel to the laying plane of the lower panel 7, with which it is integral. Preferably, the pin 53 extends and is supported between a pair of parallel plates 54, fixed, e.g. by means of screws, in correspondence to the inner face of the lower panel 7 or of the frame 7*f* thereof. The other end 52*b* of the connection member 52 has a connection pin 34*a* for the first cable 33. The connection member 52 optionally has a lower tang 52*c* (see FIG. 19) suitable, in use, for restricting the angular travel of the member itself around the pin 53.

With such a configuration, upon an angular travel occurring of the connection member 52 around the pin 53 the operation occurs of the rod 51 which is made to perform a substantially translational movement along the plane of the lower panel 7. This movement of the rod 51 causes the angular travel of the connection lever 13 around the pin 13*a*, which will thus be pushed either towards the panel 7 or in an away direction, depending on the direction taken by the angular travel of the connection member 52.

The angular movement of the connection member 52 depends, in turn, on the position taken by the lower panel 7 during the opening-closing phases of door 1. During the opening phase of door 1 in fact, the lifting of the lower panel 7 with respect to the ground causes a change in the layout of the first cable 33 with respect to the plane of the panel itself to which this is secured. The first cable 33, by changing its layout with respect to the plane of the panel 7, causes the end 52*b* of the connection member 52 to move nearer or away from the lower panel 7 and, therefore, the angular travel of the member 52 around the pin 53.

More in particular, during the opening of the door 1, the first cable 33 pulls the end 52*b* of the L-shaped connection member 52 forcing this closer to the panel 7 and therefore causing a corresponding angular movement of the connection lever 13, which, in fully open position, will find itself substantially parallel to the lower panel 7 which it helps support.

For the closing of the door 1 starting from the fully-open position, the backward movement of the lower panel 7 from its substantially horizontal position below the upper panel 8 to the substantially vertical position causes a change in the layout of the first cable 33 with respect to the panel itself and, therefore, the gradual moving away of the end 52*b* of the L-shaped connection member 52 from the lower panel 7. The connection member 52 is therefore forced to perform an angular travel around the pin 53 such that the other end 52*a* of the member 52 is pushed towards the top of the lower panel 7 and causes an upward translation of the rod 51. The translation of the rod 51 towards the upper section 7*b* of the lower panel 7 causes the rotation of the connection lever 13 around the pin 13*a* and the consequent moving away of this from the panel 7. The connection lever 13 is therefore pushed towards the compartment and correctly positioned to be able to easily collaborate with the opening of the door 1.

According to a variation of the present invention shown in the FIGS. 21 to 24, each articulation group 50 comprises a guide lever 55 having a first apex 56 engaged sliding along a guide path 57, 58 associated with the upper panel 8, and a second apex 59 articulated at the top to the lower panel 7.

More in detail, each first apex 56 has a sliding block or idle roller 60 suitable, in use, for sliding along the guide path 57, 58.

The second apex 59, instead, is pivoted in correspondence to the upper section 7*b* of the lower panel 7.

Usefully, the guide path 57, 58 is split into:

- a curvilinear section 57, which is connected to the side sliding guides 10 of the upper panel 8 and which can be covered by the first apex 56 until the upper panel 8 reaches the substantially horizontal configuration; and
- a rectilinear section 58 of the side sliding guides 10, which can be covered by the first apex 56 when the upper panel 8 is in substantially horizontal configuration.

Figure 25:
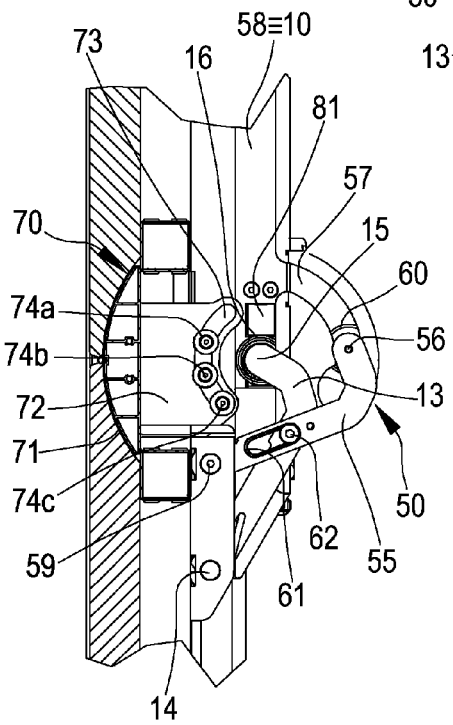
FIG. 25 shows a detailed view of a component of FIG. 21.

As can be seen from the detail view of FIG. 25, furthermore, each guide lever 55 has a guide groove 61, in which is fitted in a sliding way a hinge pin 62 associated with a corresponding connection lever 13.

By means of the guide groove 61 and the hinge pin 62, the connection lever 13 and the guide lever 55 can rotate the one with respect to the other around a rotation axis (defined by the hinge pin 62) which moves along the guide groove 61 during the lifting/lowering of the door 1.

With such a configuration of the articulation group 50, the movement of the sectional door according to the present invention is fairly stable and smooth.

In particular, it will be seen that, in the absence of the guide levers 55, the mechanical system made up of the lower panel 7, the upper panel 8 and the connection levers 13 has two degrees of freedom; thanks to the introduction of the guide levers 55, instead, the system loses one degree of freedom and the relative position of the connection levers 13 with respect to the upper panel 8 is univocally determined for any position taken up by the lower panel 7, and vice versa.

In particular, in the completely closed position (FIG. 21), the first end 15 of the connection levers 13 is blocked by the safety group 20 in correspondence to the lower section 8*a* of the upper panel 8, while the first apex 56 is fitted along the curvilinear section 57 of the guide path 57, 58.

Figure 22:
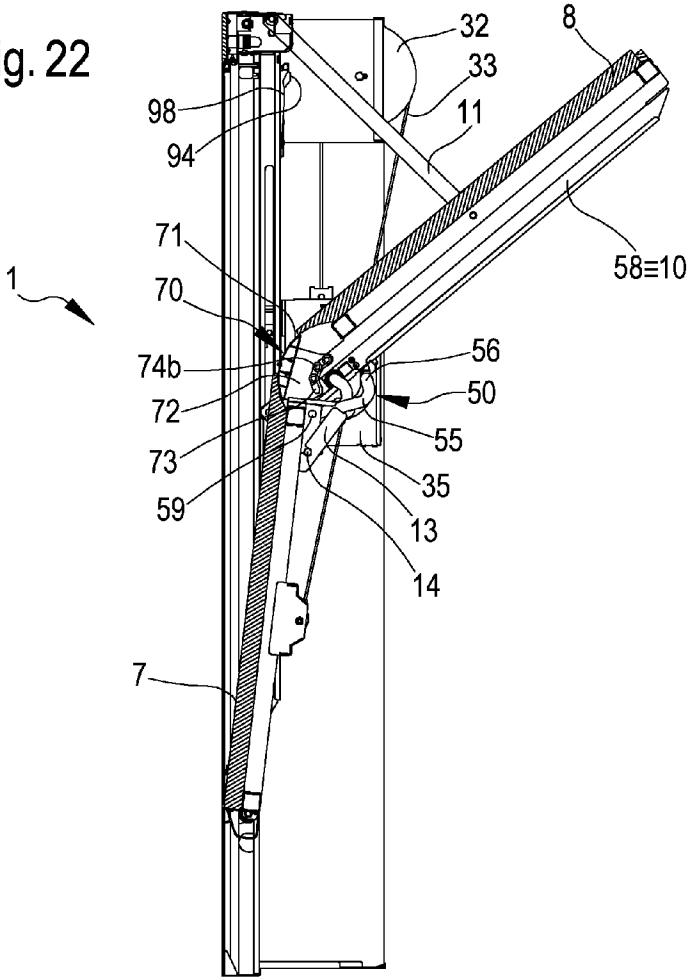
FIGS. 21 to 24 illustrate section views, on enlarged scale, taken along the track plane C-C of FIG. 2 and with removed parts, of a variation of the door according to the present invention.
Figure 21:
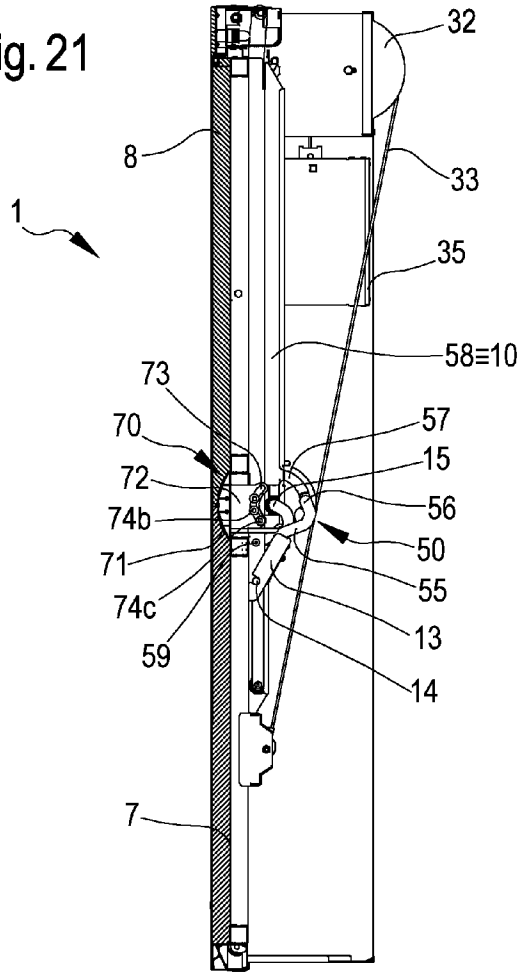

When the opening movement of the door 1 starts, see FIG. 22, with the lifting of the lower panel 7 and the angular travel of the upper panel 8 which starts to move to a substantially horizontal position, the first end 15 remains blocked by the safety group 20 while the first apex 56 covers the curvilinear section 57; the connection levers 13, therefore, do not change their angle with respect to the lower panel 7, thus keeping smoother the upward movement of the lower panel 7 until the intermediate position is reached (FIG. 23), wherein the upper panel 8 is substantially horizontal.

Figure 24:
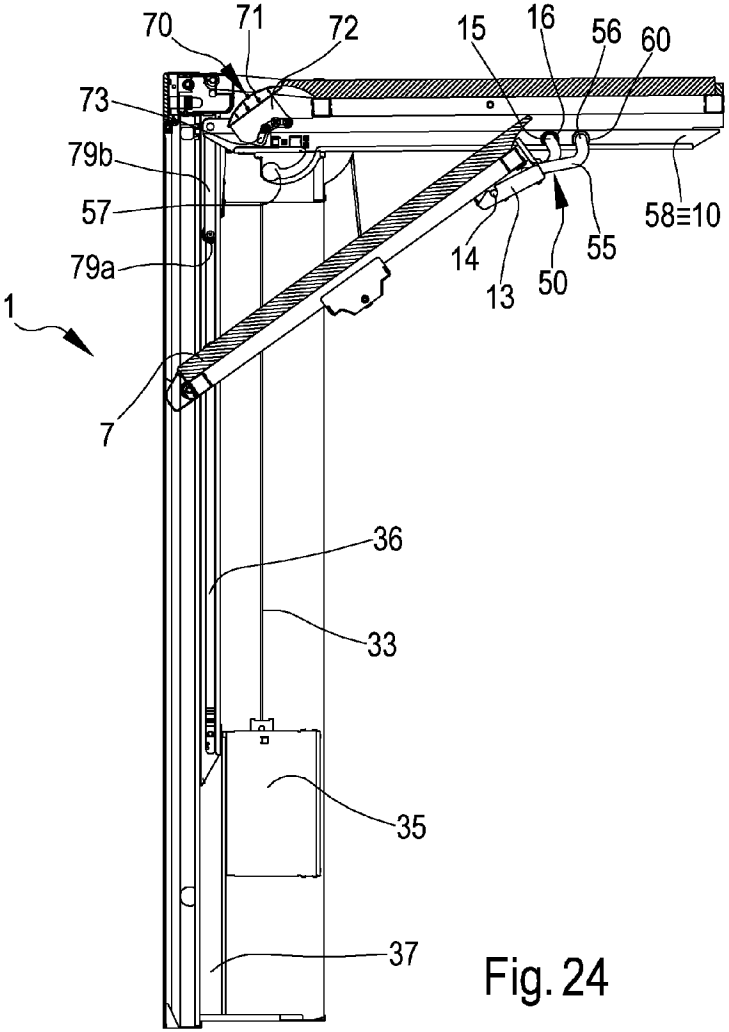
Figure 23:
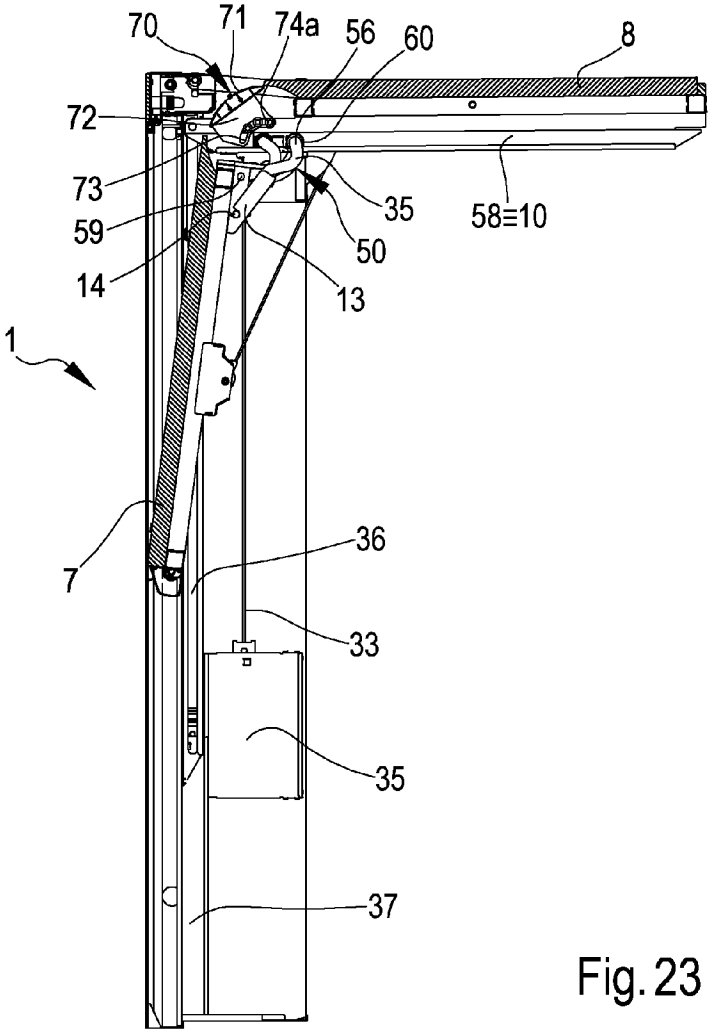

At this moment, the sliding blocks or rollers 16 of the connection levers 13 free themselves and can slide towards the portion 8*b* of the panel 8 together with the sliding blocks or rollers 60 of the guide levers 55, which slide along the rectilinear section of the side sliding guides 10 (FIG. 24).

Such sliding determines an angular movement of the connection levers 13 and of the guide levers 55 towards the lower panel 7 until the completely open position is reached, in which the connection levers 13 and the guide levers 55 end up by arranging themselves substantially parallel to the lower panel 7.

The complete closing movement of the door 1, starting from the completely open position, is performed in a specular way.

The variation shown in the FIGS. 21 to 24 also differs from the previously-illustrated embodiments because the lower panel 7 and upper panel 8 have slimmer adjacent sections 7*b*, 8*a*, with their respective faces turned towards the concave-configuration compartment and, in use, sliding by contact, during the opening-closing of the door 1, on a safety device 70 described below.

The safety device 70 comprises a crossbar 71, between the lower panel 7 and the upper panel 8 having a complementary convex configuration with respect to the concave faces of the panels 7 and 8. Such crossbar is supported laterally by the upper panel 8 by means of a pair of movable side plates 72. The movable side plates 72, in fact, have a slot 73 with elongated configuration around the rotation axis of the roller 16 of the connection lever 13 (when the door 1 is in completely closed position), which acts as a housing seat for a series of fixed pins 74*a*, 74*b*, 74*c* provided laterally on the upper panel 8 or on the inner frame 8*f*. With such a configuration, each plate of the pair of movable side plates 72 is able to move in an angular way around the above mentioned rotation axis and the position of the fixed pins 74*a*, 74*b*, 74*c* is such as to limit its angular travel during the opening-closing of the sectional door according to the present invention.

As has already been said above, the crossbar 71 and the inner faces of the lower panel 7 and upper panel 8, in correspondence to the adjacent edges, are sized so as to be in sliding contact with each other during the opening-closing of the door 1, at least until the door 1 is with the upper panel 8 in a substantially horizontal position. In such position, in fact, to allow the movement of the lower panel 7, the edge of the latter is detached from the crossbar 71 and the lower panel 7 is therefore free to slide along the side sliding guides 10 of the upper panel 8.

During the closing of the door 1, however, just as soon as the lower panel 7 starts to translate vertically downwards (see FIG. 23), the sliding contact with the crossbar 71 is re-established.

With such a configuration, the interspace between lower panel 7 and upper panel 8 always remains inaccessible and this prevents, for example, a person's hands remaining crushed during the closing of the door 1.

In the embodiment of the FIGS. 21 to 24 is also shown a variation of the counterweight means 35, 37.

Figure 26:
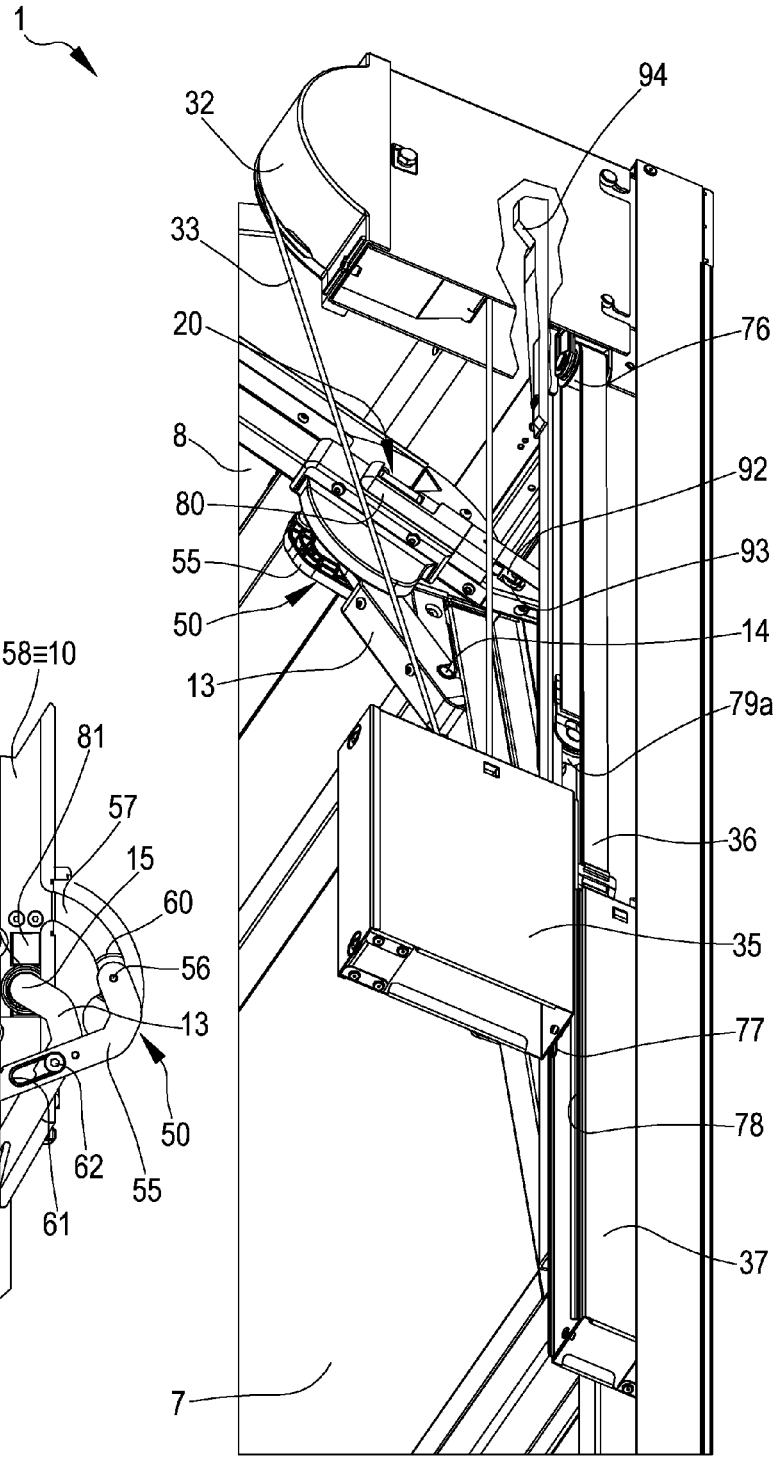
FIG. 26 illustrates an axonometric view of a detail of the variation shown in FIGS. 21 to 24.

As can also be seen in FIG. 26, the second cable 36 which sustains the second counterweight 37 is not associated with the first counterweight 35 as is shown in the FIGS. 15 to 17.

For each side of the door 1, in fact, the counterweight means 35, 37 comprise a second pulley 76 mounted revolving at the top to a respective pair of vertical guides 5, 6 and suitable for supporting the second cable 36.

One end of the second cable 36 is connected to the second counterweight 37 while the other end is connected to the upper panel 8; more precisely, the other end is connected to a small wheel or slide 79*a* which slides along the vertical guide 6 and which is connected to the upper panel 8 by means of a thrust lever 79*b*.

Advantageously, furthermore, the counterweights 35, 37 are united reciprocally by interposition of prismatic coupling means 77, 78 which allow them to slide vertically the one with respect to the other but not to move away from one another horizontally.

When the door 1 is in completely closed position (FIG. 21), the cables 33, 36 keep the counterweights 35, 37 suspended and their weight force discharges on the lower panel 7 and on the upper panel 8 respectively, favoring controlled lifting.

Once the upper panel 8 has moved to a substantially horizontal position (FIG. 23), the second counterweight 37 has reached the ground and stops acting on the upper panel 8, which remains in a substantially horizontal position. The first counterweight 35, instead, is still suspended on the first cable 33 and continues to discharge its weight on the lower panel 7 assisting with its movement until the fully-open position is reached, in which it too ends up resting on the ground.

The embodiment of the door 1 shown in the FIGS. 21 to 24 also has a variation of the safety groups 20.

As can be seen in the FIG. 26 and, more in detail, in the FIGS. 27 to 32, each safety group 20 includes a block 80 moved in correspondence to the lower section 8*a* of the upper panel 8, in the proximity of the sliding seats 17.

On the block 80 are mounted first pincers 81 and second pincers 82 which are rotatable around rotation axes 83 at right angles to the upper panel 8 between an engagement position, in which both pincers 81, 82 are fitted inside the sliding seat 17 to grip on opposite sides the roller 16 of the first end 15 of the connection levers 13, so as to prevent its sliding, and a disengagement position, wherein at least the first pincers 81 are retracted from the sliding seat 17 and the first end 15 is released and free to slide.

The pincers 81, 82 are articulated the one with the other by means of an articulation connecting rod 84 to form an articulated parallelogram; the rotation of one of the pincers 81, 82 therefore also determines the rotation of the other pincers 81, 82.

With the pincers 81, 82 is associated an elastic member 85 suitable for keeping the pincers 81, 82 in the disengagement position.

Such elastic member 85 consists of a torsion spring with the opposite ends which insist on a first rung 86 associated with the block 80 and on a second rung 87 associated with the articulation connecting rod 84.

Each safety group 20 comprises stop means 88 for the temporary blockage of the pincers 81, 82 in the engagement position in contrast with the force exercised by the elastic member 85.

The stop means 88 comprise a blockage hole 89 obtained on the first pincers 81 and in which, in the engagement position, a blockage bar 90 can be fitted.

The blockage bar 90 is sliding inside the block 80 along a direction parallel with the side sliding guides 10 and is kept pushed towards the first pincers 81 thanks to a first thrust pin 91 which insists on an auxiliary bar 92 integral with the blockage bar 90.

The auxiliary bar 92 ends up into a first wheel 93 which protrudes from the upper panel 8 and is meant to engage with a first ramp 94, which is fixed at the top of the lateral support uprights 2, 3.

The operation of the auxiliary bar 92 is assisted by an auxiliary rod 95 which is mounted on the block 80 in a sliding way along a direction parallel with the side sliding guides 10 and, thanks to a second thrust spring 96, is kept pushed in a direction in agreement with the auxiliary bar 92.

The auxiliary rod 95 supports a second wheel 97 which is arranged in the proximity of the first wheel 93 and is meant to engage with a second ramp 98, this too fixed at the top of the lateral support uprights 2, 3.

The first ramp 94 and the second ramp 98 have the same configuration with the inclined plane back orientated by a same direction with respect to the vertical guides 5, 6.

The second ramp 98, furthermore, has a basin-shaped portion 99 in which the second wheel 97 can be fitted in stable balance.

In the completely closed position of the door 1, the upper panel 8 and the block 80 are arranged substantially vertical, with the pincers 81, 82 in the engagement position and the blockage bars 90 inserted in the blockage holes 89 to make sure they are stopped. In this configuration, the rollers 16 of the connection levers 13 are blocked by the pincers 81, 82 and cannot slide along the side sliding guides 10.

As the door 1 gradually opens, the block 80 of each safety group 20 returns upwards together with the lower section 8*a* of the upper panel 8 and approaches the ramps 94, 98 mounted on the top of the lateral support uprights 2, 3.

Figure 28:
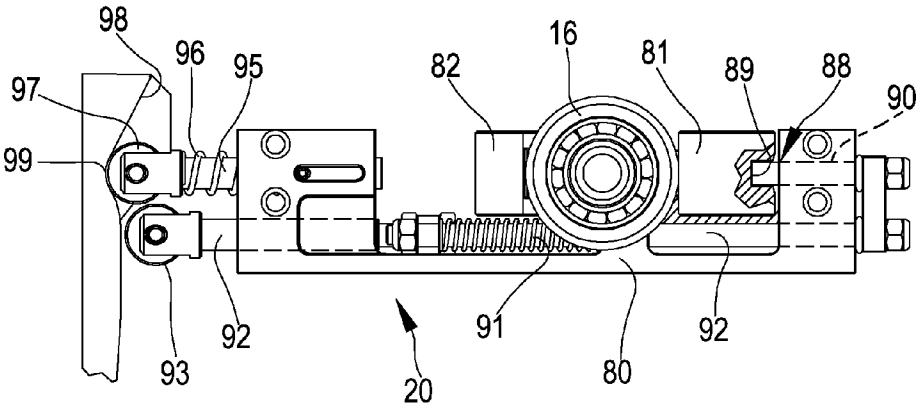
FIG. 28 illustrates a side view of the construction detail shown in FIG. 27.
Figure 27:
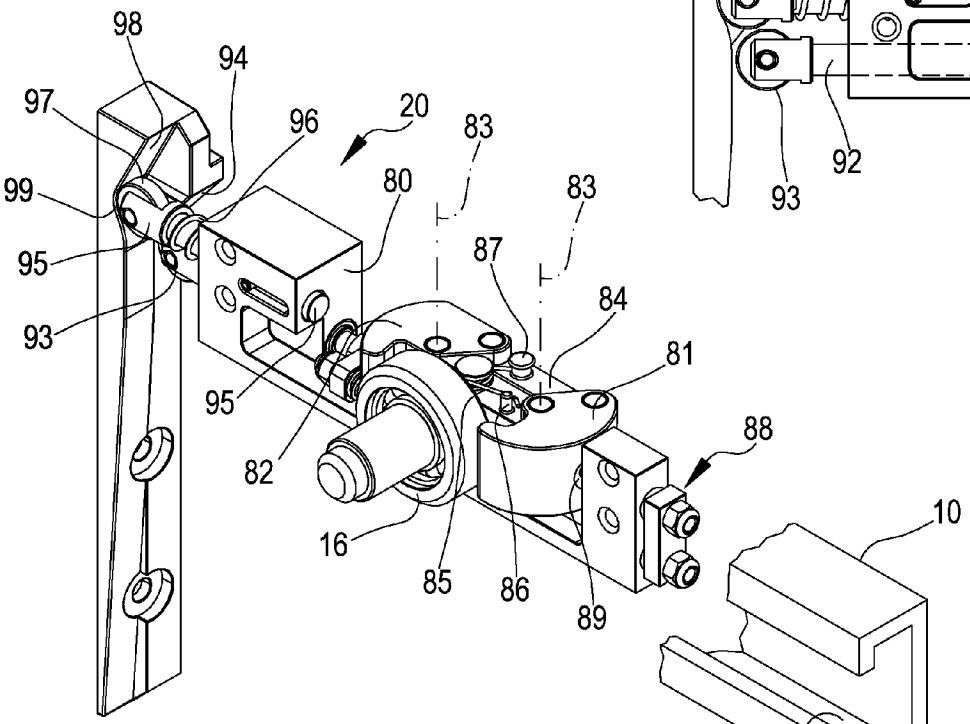
FIG. 27 illustrates an axonometric view of a construction detail of the variation shown in FIGS. 21 to 24.
Figure 27:
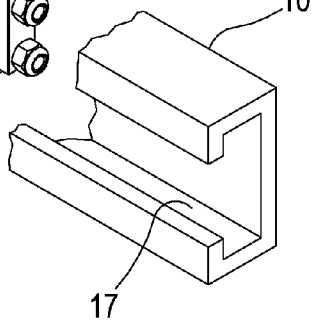

When the upper panel 8 reaches the substantially horizontal configuration, the second wheel 97 comes into contact with the second ramp 98 (FIGS. 27 and 28).

Figure 30:
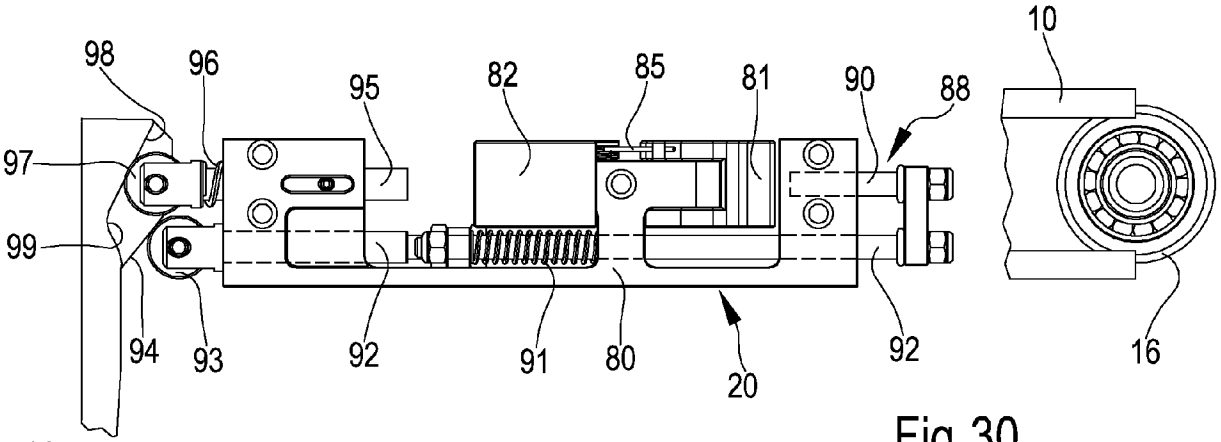
FIG. 30 illustrates a side view of the construction detail shown in FIG. 29.
Figure 29:
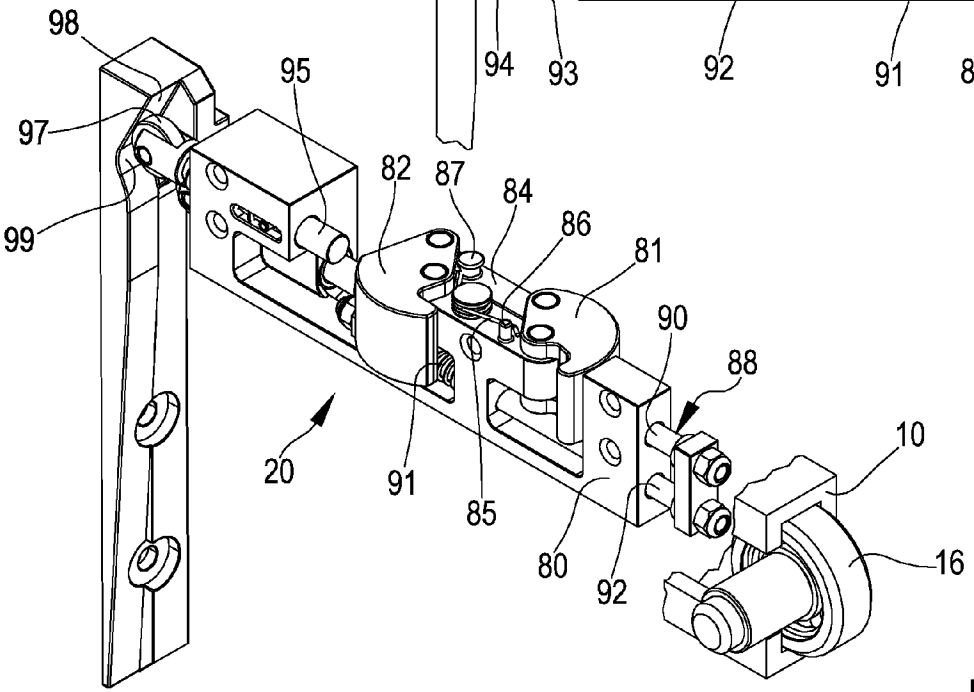
FIG. 29 illustrates an axonometric view of the construction detail of FIG. 27 in a different operating position.

The pincers 81, 82, nevertheless, remain in engagement position until a subsequent elevation of the upper panel 8 also causes the first wheel 93 to engage with the respective ramp 94 (FIGS. 29 and 30).

In this configuration, the first wheel 93 moves the auxiliary bar 92 and the blockage bar 90 in a direction away from the first pincers 81, causing the blockage bar 90 to come out of the blockage hole 89.

By effect of the elastic member 85, therefore, the pincers 81, 82 turn around the rotation axes 83 and switch from the engagement position to the disengagement position, releasing the roller 16 which can thus slide along the sliding seat 17.

Figure 32:
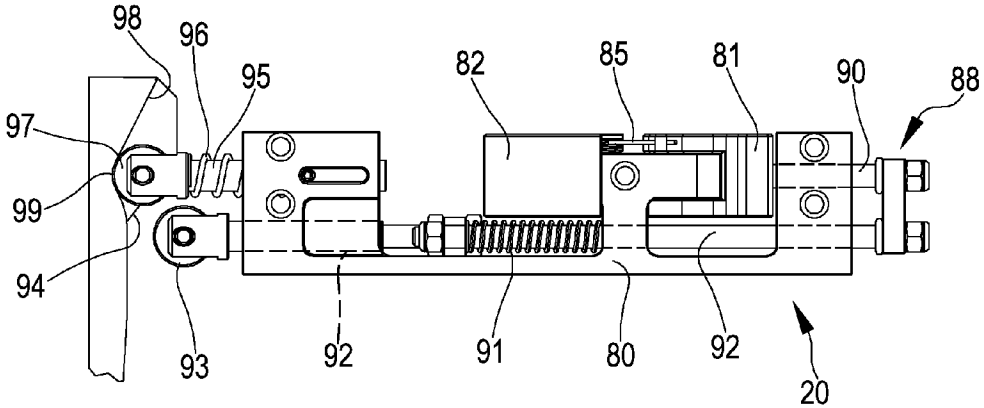
FIG. 32 illustrates a side view of the construction detail shown in FIG. 31.
Figure 31:
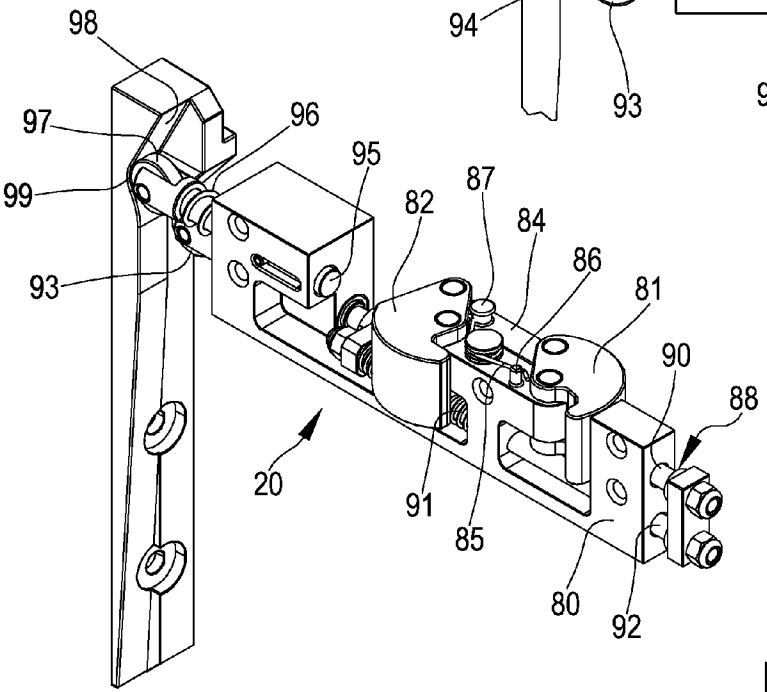
FIG. 31 illustrates an axonometric view of the construction detail of FIG. 27 in a further operating position.

Once the roller 16 has been released, the force exercised by the second thrust spring 96 insists on the second wheel 97 determining its rolling backwards on the second ramp 98 as far as the basin-shaped portion 99 (FIGS. 31 and 32).

In this position, the first wheel 93 moves away from the first ramp 94 and the first thrust spring 91 determines the sliding of the auxiliary bar 92 and of the blockage bar 90 in a waiting position wherein the blockage bar 90 is pushed up resting on the first pincers 81.

Such waiting position remains as long as the door 1 remains open.

Usefully, in the second disengagement position the second pincers 82 remain inserted in the sliding seat 17.

During the closing of the door 1, the lowering of the lower panel 7 brings the roller 16 closer to the safety group 20 until it comes into contact with the second pincers 82 which have remained inserted inside the sliding seat 17.

Under the thrust of the roller 16, the second pincers 82 turn around the corresponding rotation axis 83 and, thanks to the articulation connecting rod 84, also determine the rotation of the first pincers 81.

Both the pincers 81, 82, therefore return to the engagement position and block the sliding of the roller 16.

In this position, the blockage hole 89 again aligns itself with the blockage bar 90 which, following the pressure of the first thrust spring 91, fits inside the first pincers 81 determining the blockage thereof.

The invention claimed is:

1. Sectional door (1) for the control of the access opening to a compartment, particularly to a garage compartment, comprising:

a fixed portion including two pairs of vertical guides (5, 6) suitable for extending in a direction substantially parallel to a respective shoulder of the access opening to a compartment; and a movable portion including:

a leaf comprising a lower panel (7) and an upper panel (8), substantially rectangular in shape extending over the entire width of the leaf and having the lateral sides thereof in sliding engagement along a respective side guide (5, 6);

a pair of side support arms (11) each having one end thereof articulated in correspondence to the top of a respective pair of vertical guides (5, 6) and the other end thereof pivoted in correspondence to an intermediate zone (8*c*) of a respective lateral side of said upper panel (8); and articulated and slidable connection means (12) between said lower panel (7) and said upper panel (8), including a pair of lateral sliding guides (10) provided in correspondence to the lateral sides of said upper panel (8), and a pair of connection levers (13), each having one end (15) thereof in sliding engagement with a respective lateral sliding guide (10) of said upper panel (8) and a second end (14) thereof articulated at the top to said lower panel (7), whereby said lower panel (7) and upper panel (8) are movable between a completely closed position of said access opening, in which they are arranged in a substantially aligned sequence, one on top of the other, along said pairs of vertical guides (5, 6), and a completely open position, in which said upper panel (8) is overhangingly moved to project in said compartment starting from a zone in correspondence to the top of said pairs of vertical guides (5, 6), supported by said pair of side support arms (11) and said lower panel (7) is moved together with, and against said upper panel (8).

2. Door (1) according to claim 1, wherein said first end (15) of the connection levers (13) slides in a sliding seat (17) obtained in said side sliding guides (10) of the upper panel (8).

3. Door (1) according to claim 2, wherein said first end (15) of the connection levers (13) has a sliding block or idle roller (16) fitted sliding along said sliding seat (17).

4. Door (1) according to claim 1, wherein said connection levers (13) comprise resilient loading means (18).

5. Door (1) according to claim 1, wherein said fixed portion comprises a pair of lateral support uprights (2, 3) each having a respective pair of vertical guides (5, 6) and suitable for being fastened to the shoulders and lintel, respectively, of said access opening to the compartment.

6. Door (1) according to claim 5, wherein said pair of lateral support uprights (2, 3) is connected at the top by at least one crossbar (4).

7. Door (1) according to claim 5, wherein each pair of vertical guides (5, 6) comprises at least a sliding guide (5) having a length substantially equal to that of the respective lateral support upright (2, 3).

8. Door (1) according to claim 5, wherein each pair of vertical guides (5, 6) comprises at least a sliding guide (6) having a length substantially equal to half that of the respective lateral support upright (2, 3) extending parallel and adjacent to the other guide (5) of said pair of vertical guides roughly in correspondence to the upper half of said lateral support upright (2, 3).

9. Door (1) according to claim 5, wherein each side support arm (11) has one end thereof pivoted at the top to a respective lateral support upright (2, 3).

10. Door (1) according to claim 1, wherein said lower panel (7) and said upper panel (8) have a respective inner frame (7*f*, 8*f*).

11. Door (1) according to claim 2, wherein said door (1) comprises at least a safety group (20) suitable for:

temporarily blocking said first end (15) of the connection levers (13) in the proximity of a lower section (8*a*) of the upper panel (8) until said upper panel (8) reaches a substantially horizontal configuration, and for releasing said first end (15) of the connection levers (13), leaving this free to slide along the respective side sliding guide (10), when said upper panel (8) is in a substantially horizontal configuration.

12. Door (1) according to claim 11, wherein said safety group (20) comprises an equalizing member (21) pivoted on an intermediate pin (22) borne in correspondence to said lower section (8*a*) of the upper panel (8) and having two slots (23, 24), one engaging with a pin (19*a*) fastened to one grip pawl (19), while the other engaging with a pin (25*a*) fastened to a wedge (25).

13. Door (1) according to claim 12, wherein said grip pawl (19) and said wedge (25) have the same configuration with inclined plane back (19*b*, 25*b*) orientated by a same direction and are fitted sliding within a respective through housing opening (26, 27), leading into the respective sliding seat (17), so that, depending on the angular position of the equalizing member (21) in the sliding seat (17) involved, either the grip pawl (19) or the wedge (25) protrudes.

14. Door (1) according to claim 12, wherein said equalizing member (21) has coupling means (30) for coupling to one of said side support arms (11).

15. Door (1) according to claim 14, wherein said coupling means comprise a hook portion (30) designed to engage with a respective tang (31) provided on one of said side support arms (11) adjacent to it.

16. Door (1) according to claim 13, wherein said safety group (20) comprises at least resilient loading means (21*a*) suitable for keeping said grip pawl (19) protruding in said sliding seat (17).

17. Door (1) according to claim 11, wherein said safety group (20) includes a first pincer (81) and a second pincer (82) moved in correspondence to said lower section (8*a*) of the upper panel (8) and rotatable between an engagement position, in which both pincers (81, 82) are fitted inside said sliding seat (17) to grip on opposite sides said first end (15) of the connection levers (13), and a disengagement position, wherein at least said first pincer (81) is retracted from said sliding seat (17) to release said first end (15).

18. Door (1) according to claim 17, wherein said pincers (81, 82) are articulated the one to the other by means of an articulation connecting rod (84) to form an articulated parallelogram.

19. Door (1) according to claim 17, wherein in said disengagement position said second pincers (82) remains fitted inside said sliding seat (17).

20. Door (1) according to claim 17, wherein said safety group (20) comprises at least one elastic member (85) suitable for keeping said pincers (81, 82) in said disengagement position.

21. Door (1) according to claim 20, wherein said safety group (20) comprises stop means (88) for the temporary blockage of said pincers (81, 82) in said engagement position in contrast with said elastic member (85).

22. Door (1) according to claim 1, wherein said door (1) comprises counterweight means (35, 37) for controlling the movements of said lower panel and upper panel (7, 8).

23. Door (1) according to claim 22, wherein said counterweight means (35, 37) comprise at least one first pulley (32) fitted revolving at the top to a respective pair of vertical guides (5, 6) and suitable for supporting a first cable (33) connected, in correspondence to one of its ends, to said lower panel (7) and at the other end to at least a first counterweight (35).

24. Door (1) according to claim 23, wherein said counterweight means comprise at least a second counterweight (37) connected to said first counterweight (35) by means of at least a second cable (36).

25. Door (1) according to claim 23, wherein said counterweight means (35, 37) comprise at least one second pulley (76) fitted revolving at the top to a respective pair of vertical guides (5, 6) and suitable for supporting a second cable (36) connected, in correspondence to one of its ends, to said upper panel (8) and at the other end to at least a second counterweight (37).

26. Door (1) according to claim 1, wherein said door (1) comprises at least one articulation group (50) associated with said articulated and slidable connection means (12) and suitable for guiding the movement of said connection levers (13) during the movement of said lower panel (7) and upper panel (8) between said completely closed position and said completely open position.

27. Door (1) according to claim 26, wherein:

said door (1) comprises counterweight means (35, 37) for controlling the movements of said lower panel and upper panel (7, 8), said counterweight means (35, 37) comprising at least one first pulley (32) fitted revolving at the top to a respective pair of vertical guides (5, 6) and suitable for supporting a first cable (33) connected, in correspondence to one of its ends, to said lower panel (7) and at the other end to at least a first counterweight (35); and said articulation group (50) comprises:

at least one rod (51) connected, in correspondence to one of its ends (51*b*), to a respective connection lever (13); and at least one connection member (52) articulated to said lower panel (7) in correspondence to a central portion thereof and having a first end (52*a*) articulated to the other end (51*a*) of said rod (51) and a second extremity (52*b*) connected to said first cable (33).

28. Door (1) according to claim 27, wherein said connection member (52) has a substantially L-configuration and is fitted revolving on a pin (53) supported by said lower panel (7).

29. Door (1) according to claim 26, wherein said articulation group (50) comprises a guide lever (55) having a first apex (56) engaged sliding along a guide path (57, 58) associated with said upper panel (8) and a second apex (59) articulated at the top to said lower panel (7).

30. Door (1) according to claim 29, wherein said guide path (57, 58) comprises:

at least a curvilinear section (57), which is connected to said side sliding guides (10), which can be covered by said first apex (56) until said upper panel (8) reaches a substantially horizontal configuration;

at least a rectilinear section (58) of said side sliding guides (10), which can be covered by said first apex (56) when said upper panel (8) is in a substantially horizontal configuration.

31. Door (1) according to claim 1, wherein said door (1) comprises anti-tampering means (38) comprising at least one rod (39), which is fitted translatable in or on said upper panel (8) and having at least one resilient recalling means (38*a*), one fixed locator with inclined plane (42) suitable for engaging sliding at the top said at least one rod (39) when placing said upper panel (8) in vertical layout during the closing phase of the door (1), and a blind seat (41) obtained in said lower panel (7) designed to be engaged in a removable way by a respective rod (39).

32. Door (1) according to claim 1, wherein said door (1) comprises a safety device (70) comprising:

at least one crossbar (71), between said lower panel (7) and said upper panel (8) having a complementary configuration with respect to the faces of said panels (7) and (8) turned towards said compartment, at least one pair of movable side plates (72) supporting said crossbar laterally to said upper panel (8), each of said side plates (72) having a slot (73), and a series of pins (74*a*, 74*b*, 74*c*) fixed laterally to said upper panel (8) and suitable, in use, for being received in a respective slot (73) of each plate of said movable side plates (72) in order to limit the angular travel thereof around a rotation axis.

* * * * *